US010584531B2

(12) United States Patent
Ramsey

(10) Patent No.: US 10,584,531 B2
(45) Date of Patent: Mar. 10, 2020

(54) GATE HINGE WITH DIRECT ATTACHMENT TO A SUPPORT POST

(71) Applicant: Rex A. Ramsey, Forney, TX (US)

(72) Inventor: Rex A. Ramsey, Forney, TX (US)

( * ) Notice: Subject to any disclaimer, the term of this patent is extended or adjusted under 35 U.S.C. 154(b) by 101 days.

(21) Appl. No.: 15/298,450

(22) Filed: Oct. 20, 2016

(65) Prior Publication Data

US 2017/0247944 A1 Aug. 31, 2017

Related U.S. Application Data

(60) Provisional application No. 62/300,963, filed on Feb. 29, 2016.

(51) Int. Cl.

| | |
|---|---|
| ***E06B 11/02*** | (2006.01) |
| ***E06B 11/04*** | (2006.01) |
| ***E05C 3/14*** | (2006.01) |
| ***E05D 5/02*** | (2006.01) |
| ***E05D 5/04*** | (2006.01) |
| ***E04H 17/14*** | (2006.01) |
| *E05D 3/02* | (2006.01) |

(52) U.S. Cl.

CPC ..... *E06B 11/022* (2013.01); *E04H 17/143* (2013.01); *E05C 3/14* (2013.01); *E05D 5/02* (2013.01); *E05D 5/04* (2013.01); *E06B 11/04* (2013.01); *E04H 2017/1473* (2013.01); *E05D 3/02* (2013.01); *E05Y 2600/502* (2013.01); *E05Y 2600/626* (2013.01); *E05Y 2600/63* (2013.01); *E05Y 2600/634* (2013.01); *E05Y 2800/205* (2013.01); *E05Y 2900/40* (2013.01)

(58) Field of Classification Search

CPC . E05C 3/14; E06B 11/022; E05D 5/02; E05Y 2900/40; E04H 2017/1473

USPC ..... 256/26, 73

See application file for complete search history.

(56) References Cited

U.S. PATENT DOCUMENTS

| | | | | |
|---|---|---|---|---|
| 1,168,523 A * | 1/1916 | Louden | E05D 5/02 | 16/253 |
| 2,346,111 A | 4/1944 | MacKenzie | | |
| 2,560,014 A * | 7/1951 | Wadsworth | E04H 17/003 | 256/22 |
| 2,763,890 A * | 9/1956 | Cox | E05D 5/02 | 16/253 |
| 3,811,149 A * | 5/1974 | Griffin | E05D 7/0423 | 16/240 |
| 4,010,504 A * | 3/1977 | Griffin | E05D 5/02 | 16/252 |
| 4,047,332 A * | 9/1977 | Benoit | E05D 7/06 | 49/236 |
| 4,079,481 A * | 3/1978 | Cacicedo | E05D 5/02 | 16/253 |

(Continued)

*Primary Examiner* — Gregory J Strimbu

(74) *Attorney, Agent, or Firm* — Abel Schillinger, LLP

(57) ABSTRACT

A fence system with a gate assembly mounted in a gap between first and second fence portions of the fence system. The gate assembly can be mounted directly to a post of the first or second fence portions without being mounted to pickets or backer rails of the fence portions. A hinge may be used to mount the gate assembly, where the hinge has a clamp fixed to a support which is fixed to a first member of the hinge. A second member of the hinge can be mounted to the gate assembly with the first and second members being rotatably fixed together, thereby allowing rotation of the gate assembly between open, closed, and various other positions.

17 Claims, 12 Drawing Sheets

(56) References Cited

U.S. PATENT DOCUMENTS

| | | | | |
|---|---|---|---|---|
| 4,337,548 | A * | 7/1982 | Bonar | E05D 7/06 16/311 |
| 4,451,072 | A * | 5/1984 | Petty, Sr. | E05C 3/14 292/104 |
| 4,592,578 | A * | 6/1986 | Martin | E05B 65/06 292/148 |
| 4,691,541 | A * | 9/1987 | McQuade, Sr. | E05B 65/0007 292/207 |
| 4,729,149 | A * | 3/1988 | Brunkan | E06B 11/04 16/252 |
| 5,016,928 | A | 5/1991 | Segovia | |
| 5,042,198 | A * | 8/1991 | Privratsky | E05D 3/12 16/366 |
| 5,199,218 | A * | 4/1993 | McQuade | E05D 5/06 16/379 |
| 5,868,382 | A | 2/1999 | Groves | |
| 6,010,117 | A | 1/2000 | Doxey | |
| 6,176,043 | B1 | 1/2001 | Gibbs | |
| 7,017,958 | B1 | 3/2006 | Bowers | |
| 2004/0189019 | A1 * | 9/2004 | Kooistra | E05D 7/06 292/304 |
| 2005/0061041 | A1 | 3/2005 | Rosenberg | |
| 2010/0156119 | A1 * | 6/2010 | Mueller | E05B 15/0205 292/126 |
| 2012/0090136 | A1 * | 4/2012 | Fields | E05D 5/10 16/386 |

* cited by examiner

GATE HINGE WITH DIRECT ATTACHMENT TO A SUPPORT POST

CROSS-REFERENCE TO RELATED APPLICATION

This application claims the benefit under 35 USC § 119 of the filing date of U.S. Provisional Patent Application Ser. No. 62/300,963 filed 29 Feb. 2016. The entire disclosure of this prior application is incorporated herein by this reference.

BACKGROUND

The present disclosure relates generally to fence systems, and, in an embodiment described herein, more particularly provides a hinge and a latch for a gate that attaches directly to a support post.

SUMMARY

In the disclosure below, a gate hinge and latch set is provided which brings improvements to the art of fence systems. Examples of these fence systems and the gate hinge and gate latch are described below.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
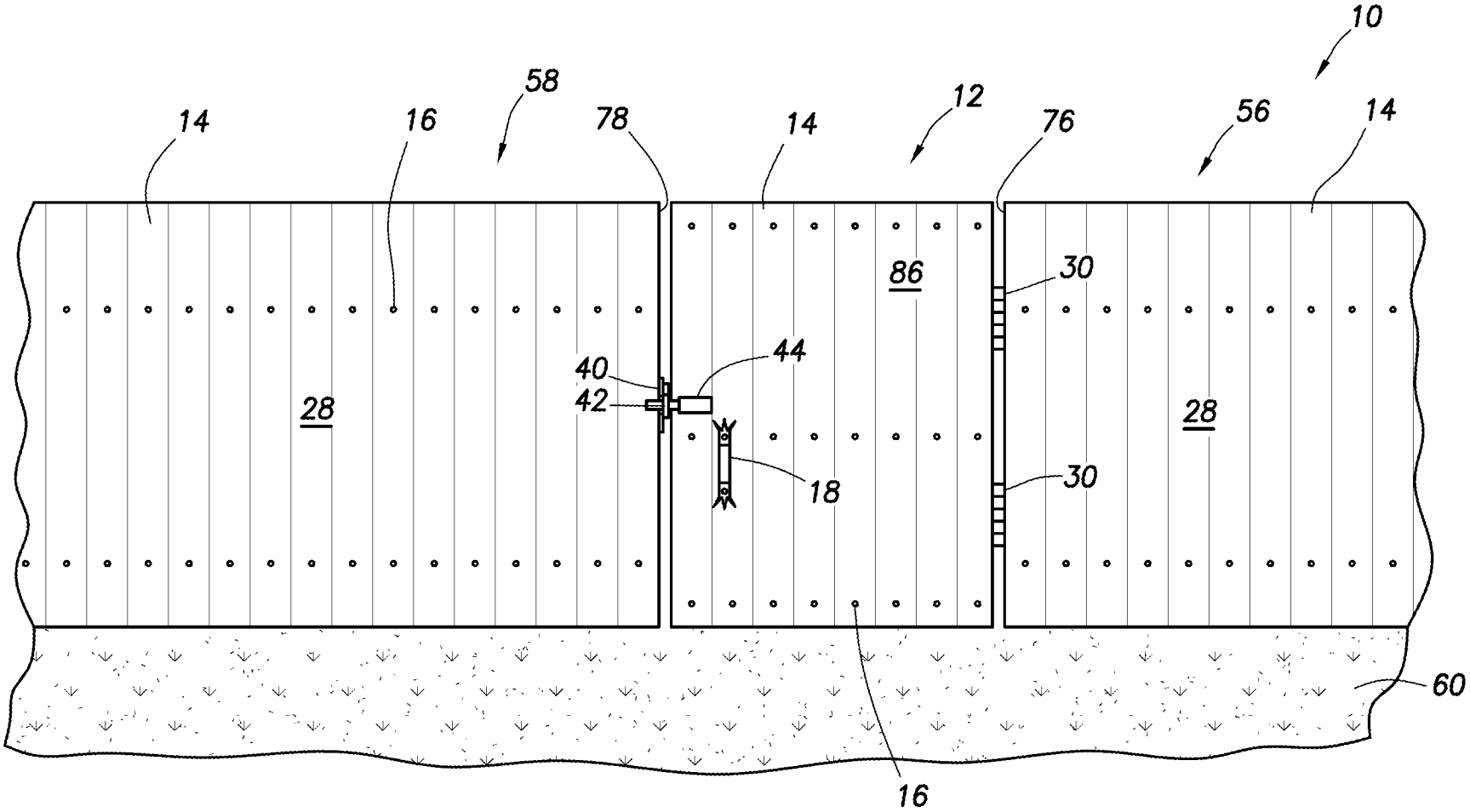
FIG. 1 is a representative front view of a fence system including a gate that is installed using a hinge and a latch set that can embody principles of the current disclosure.

Representatively illustrated in FIG. 1 is a front view of a fence system 10 with a hinge 30 and latch 40 for a gate assembly 12 that can embody principles of this disclosure. The fence system 10 shown in FIG. 1 is a type of fence system 10 that may be referred to as a privacy fence. FIG. 1 shows a fence system 10 with wooden pickets 14 that provide a barrier between two areas, with one area in front of the fence system 10 and the other area in back of the fence system 10. Someone in the front area may view a more esthetic side of the fence system 10, without being able to see some of the supporting structures (e.g. posts, brackets, fence back rails, gate support frame, etc.) on a back side of the fence system 10. A wall of pickets 14 may provide a uniform appearance when viewed from the front area. FIG. 1 shows pickets 14 positioned side-by-side along the fence system 10 with minimal to no gap between adjacent pickets 14.

However, it is not required that the fence system 10 be a wooden fence system, a privacy fence system, or a wooden privacy fence system. For example, the fence system 10 can be a decorative fence that allows at least partial viewing through the pickets 14. Additionally, the fence system 10 can be short enough for people in the front area to see over the fence system 10 into the back area. The fence material for the slats, posts, support rails, etc. can be wooden, and various other materials can also be used, such as metal (aluminum, steel, galvanized metal, iron, alloys, etc.), plastic, composites, etc.

Many fence systems have hinges that are mounted to slates and/or support rails of the fence system. These hinges may have a tendency to degrade the attachment of the hinges to the slates and/or support rails. This degradation may lead to loose hinges and thus allowing the hinges to move relative to the slates and/or support rails. The more movement is allowed at the hinge attachment points the more operation problems can be caused for the gate, such as misalignment, failure of the latch, gate dragging on ground when opening or closing, etc.

The fence system 10 has multiple pickets 14 mounted to backer rails 22 (not shown, see FIG. 2) to form a wall of pickets 14 that can be a barrier between the front and back areas. A gate assembly 12 is installed in a gap between left and right portions 56, 58 of the fence system (please note that the left and right portions 56, 58 are in reference to the rear view in FIG. 2). The gate assembly may help control access between the front and back areas. One or more hinges 30 may be attached between the gate assembly 12, thereby pivotally mounting the gate assembly 12 to the left portion 56. A latch 40 can be mounted between the gate assembly 12 and the right portion 58. The latch 40 can include an actuator 42 and a retainer 44, with the actuator 42 mounted to one of the gate assembly 12 or the right portion 58, and the retainer 44 mounted to the other. Therefore, when the gate assembly 12 is rotated about an axis 32 of the hinges 30, the retainer 44 can engage the actuator 42, latching the retainer 44 in the actuator 42, and preventing disengagement of the retainer 44 from the actuator 42, thereby preventing rotation of the gate assembly 12. If the actuator 42 is again actuated, the retainer 44 can be released from the actuator 42, thereby allowing the gate to be rotated to an open position.

FIG. 1 shows a ground 60 to which the fence system 10 can be assembled. The ground 60 is shown to be dirt with grass on its surface, but the ground 60 can also refer to concrete, rocks, gravel, or any suitable surface for installing the fence system 10. FIG. 1 also shows fasteners 16 that may used be to attach the pickets 14 to backer rails 22 (see FIG. 2). The fasteners 16 can be any fastener that is suitable for attaching the pickets 14 to a support structure of the fence, such as backer rails 22.

Figure 2:
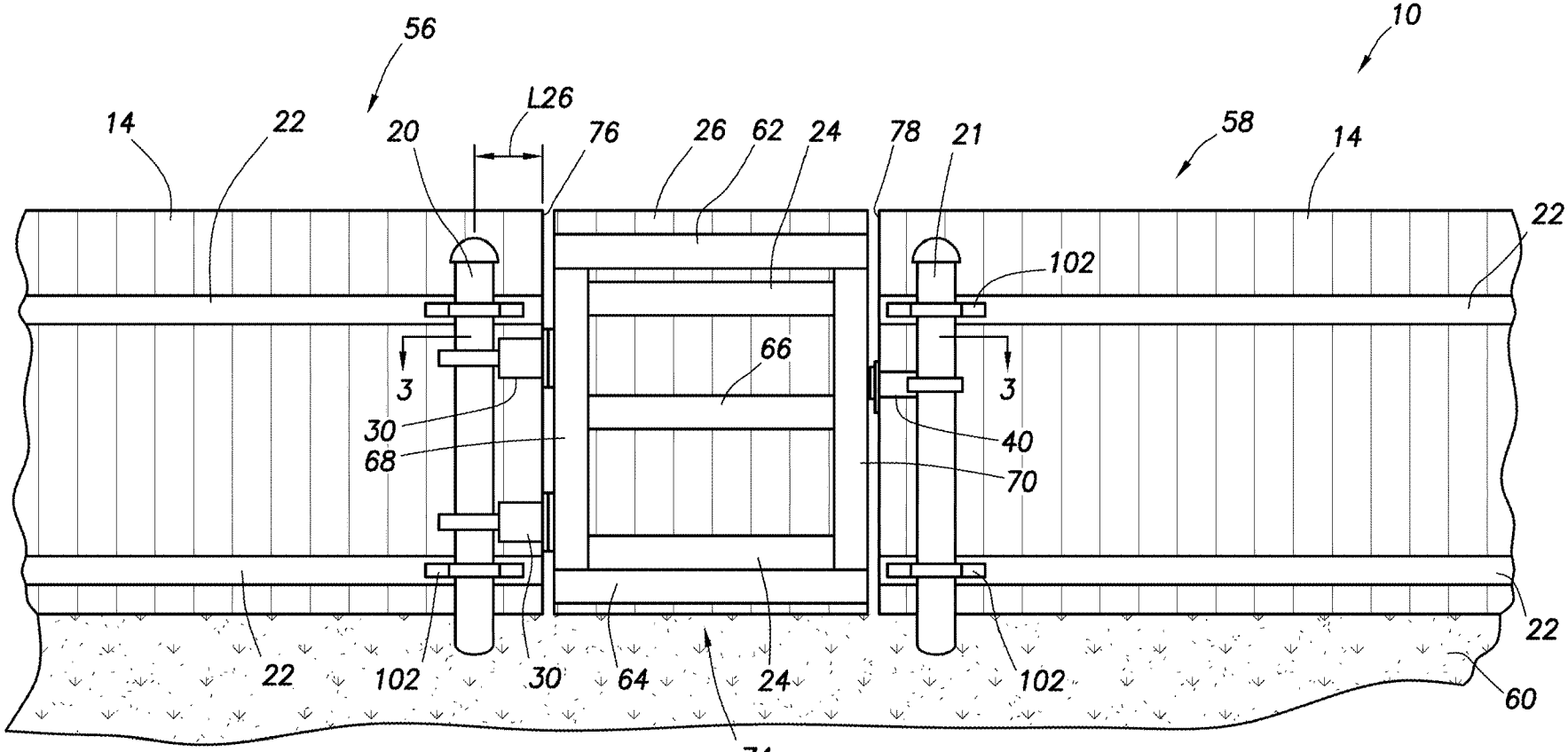
FIG. 2 is a representative rear view of the fence system of FIG. 1.

Representatively illustrated in FIG. 2 is a rear view of the fence system 10. The gate assembly 12 is installed in a gap between the left portion 56 and the right portion 58 of the fence system 10. The left portion 56 and right portion 58 can include pickets 14 attached in a vertical orientation to the backer rails 22 with fasteners 16. The backer rails 22 can be attached in a horizontal orientation to support posts 20 with brackets 102. However, it is not required that the pickets 14 and the backer rails 22 be oriented as shown in FIG. 2. The backer rails 22 and pickets 14 could be attached in the fence system 10 in various orientations, for example to match a contour of the ground 60, to provide angled pickets 14 for a different esthetic, etc.

As seen in FIG. 2, a bracket 102 extends to a left and right of a post 20, 21. The bracket 102 can include a clamp portion that clamps the bracket 102 to the post 20, 21, and a flange portion that attaches to a backer rail 22, thereby securing the backer rails 22 to the bracket 102 and thus to the post 20, 21. The flange extends to the left and right of the post 20, 21 along the backer rail 22, and can provide clearance beside the post 20, 21 to install fasteners through holes in the bracket 102 and into the backer rail 22. The flange extension, causes the backer rails 22 and the pickets 14 of the left and right fence portions 56, 58 to be extended past the posts 20, 21, respectively. This extension causes the posts 20, 21 to be inset back from the edges 76, 78, respectively. This creates a length L26 between an edge 76 and a center 72 of the post 20, and length L28 (see FIG. 3) between an edge 78 and a center 72 of the post 21.

FIG. 2 shows a support structure of the gate assembly 12 that can be used to provide strength and stability to the gate assembly and provide support for attaching backer rails 24 and pickets 26 in the gate assembly. The structure can include left and right vertical supports 68, 70, and top, middle, and bottom supports 62, 66, 64 that are fixedly attached together (such as with welding, fasteners, etc.) to form a generally rectangular-shaped frame 74. However, please note that this frame 74 can be made to any number of shapes, such as circular, square, oval, triangular, etc. and any number of supports can be used to create these different shaped frames 74. For example, the frame 74 in FIG. 2 can be made with two supports 66 in the middle with the supports 66 crisscrossing each other to form an "X" shape. Therefore, it is clearly understood that various shapes and sizes of frames 74, and various arrangements and sizes of supports can be used in keeping with principles of the current disclosure. Please note that the supports 62, 66, 64, 68, and 70 can be made of any material suitable for maintaining structural integrity of the gate assembly (such as metal, wood, plastic, etc.).

Two hinges 30 are fixedly attached to the post 20 and the support 68 of the frame 74, with the pivot 33 (such as a pin, etc.) positioned between the support 68 and the post 20. This allows the gate assembly to pivot about the axis 32 of the pivot 33 to open, closed, or somewhere in between the open and closed positions. It is generally desired to latch the gate assembly 12 in the closed position when it is pivoted to the closed position. The latch 40 can provide this latching function for the fence system 10. The actuator 42 of the latch 40 can be fixedly attached to the post 21 (such as with clamps, welding, fasteners, etc.). The latch retainer 44 can be fixedly attached the gate assembly 12 in a position that allows engagement of the actuator 42 when the gate assembly 12 is pivoted to its closed position. The retainer 44 could be mounted to a front surface 86 of the gate assembly 12 and extend from the surface 86 to engagement with the actuator 42. Alternatively, or in addition to, the retainer could be mounted to the support 70 and extend to the front surface 86. Various arrangements and attachments can be used for the retainer 44, as long as the retainer 44 engages the actuator 42 and latches the gate assembly 12 in its closed position. To release the retainer 44, the actuator 42 can merely be actuated again to allow the retainer 44 to be moved out of engagement with the actuator 42.

Figure 3:
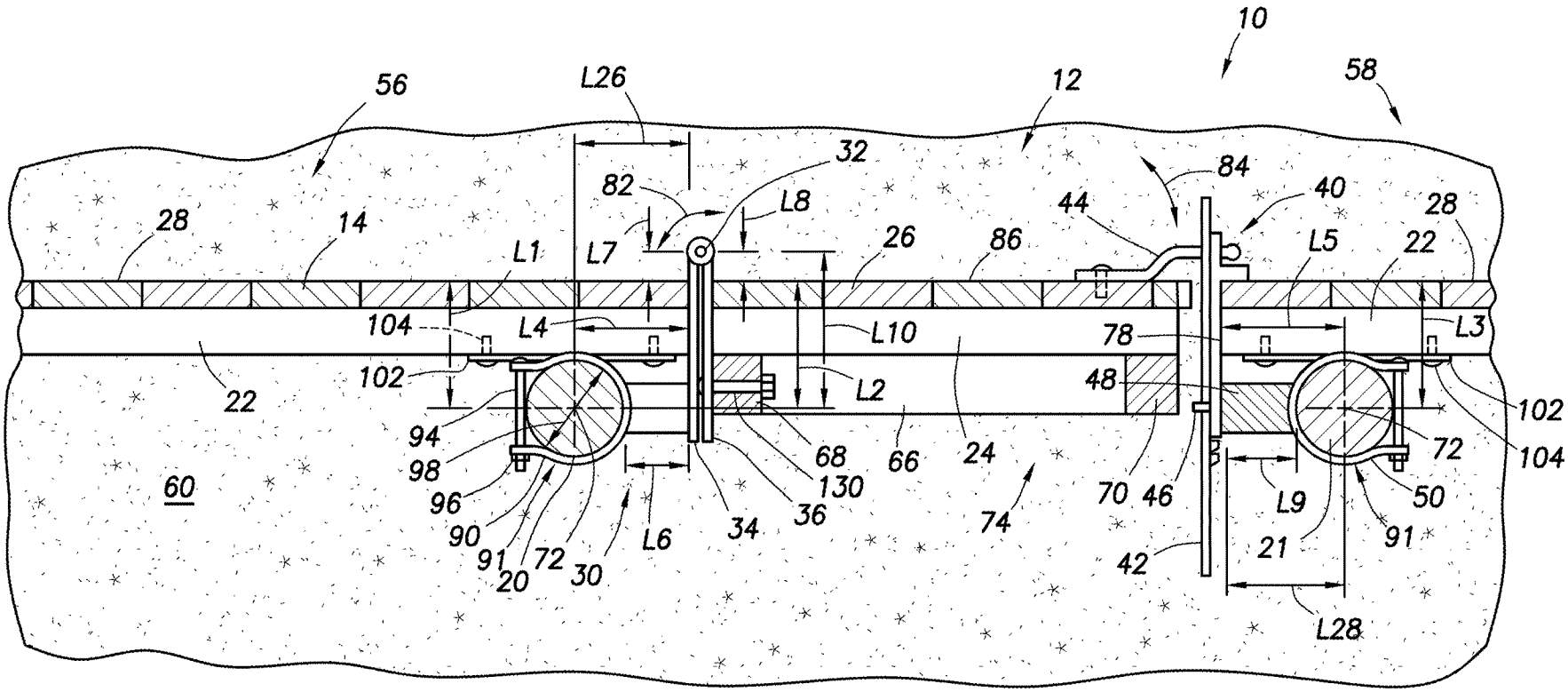
FIG. 3 is a representative top view of a gate installation in the fence system of FIG. 1.

Referring to FIG. 3, this is generally a cross-sectional view taken along line 3-3 in FIG. 2. Details of the hinge 30 and latch 40 are more clearly seen. The fence system 10 includes the pickets 14 of the fence portions 56, 58 mounted to backer rails 22, and the pickets 26 of the gate assembly 12 mounted to the backer rails 24. The brackets 102 can be mounted to the backer rails 22 with fasteners 104. The brackets 102 can be mounted to the posts 20, 21 with clamp portions (not shown), thereby fixedly attaching the pickets 14, to the backer rails 22, and thus to the posts 20, 21. This results in a distance L1 between the center 72 of post 20 and the surface 28, and a distance L3 between the center 72 of post 21 and the surface 28. Distances L1, L3 are substantially equal in FIG. 3, and can be different values if desired. The main desire may be that the surface 28 of the left portion 56 is generally in the same plane as the surface 28 of the right portion 58, however, this is not a requirement of the fence system 10. The distance L2 is a distance between the center 72 of post 20 and the surface 86 of the gate assembly 12 when the gate assembly 12 is in a closed position. As used herein, "the same plane" refers to a plane that is formed by the surfaces 28 of the left and right fence portions 56, 58 that are proximate the gate assembly, and that these surfaces 28 are aligned with the surface 86 of the gate assembly 12, such that the surface 86 lies generally within the plane. As used herein, "generally in the same plane" can include various undulations of the surfaces 28, 86, and various small protrusions from the plane caused by physical properties of the pickets 14 and/or fence system 10. However, on average the surface 28 proximate the gate assembly and the surface 86 are aligned with each other when the gate assembly is in a closed position.

Possibly due to the brackets 102 (but could be due to other factors as well), the posts 20, 21 are inset from the edges 76, 78, at distances L26, L28, respectively. Various prior art hinges are mounted to the surface 28 of the pickets 14 with fasteners that may extend through a hinge flange, through a picket 14 and into a backer rail 22. These hinges are prone to the fasteners degrading their attachment to the pickets 14 and backer rails 22 such that they can allow the gate assembly to sage (or otherwise become misaligned) causing interference of the gate with the right portion 58, the ground 60, the actuator 42, etc. The prior art hinge may continue to wobble relative to its fasteners causing further degradation and possibly failure of the attachment. Even if the fasteners of the prior art hinges were extended into the post 20, there may still be a tendency to degrade the stability of the attachment due to the pickets 14 and backer rails 22 being made from more pliable material (e.g. wood, composite, plastic, thin metal, corrugated metal, etc.). This pliability can allow the attachment of the prior hinges to degrade over time to an extent that it can prevent the gate assembly 12 from working properly.

The hinge 30 and latch 40 of the current disclosure can be used to eliminate (or at least minimize) degradation of its attachment to the posts 20, 21, respectively. The hinge 30 and latch 40 can be attached directly to either one of the posts 20, 21 via a rigid (reduced pliability) material (such as steel, aluminum, hardened plastic, composites, etc.) without fastening to and/or through other fence material(s) (such as pickets 14, backer rails 22, etc.). This means that the other fence material(s) are not used in the attachment of the hinge 30 or latch 40 to either one of the posts 20, 21. The other fence material(s) may be attached to the posts 20, 21, but they are more accurately seen as being attached in "parallel"

to, but not incorporated into, the attachment of the hinge 30 or the latch 40 to either one of the posts 20, 21. The term "parallel" refers to separate connections of the hinge 30 (or latch 40) and the other material(s) to either one of the posts 20, 21. The hinge 30 can include left and right members 34, 36, with the right member 36 being fastened directly to the support 68 of the gate assembly 12. This support can also be made from a rigid (reduced pliability) material (such as steel, aluminum, hardened plastic, etc.). The right member 36 can include a captive nut 132 (see FIG. 5A) for ease of assembly, but it is not required for the nut 132 to be captive. The nut 132 can receive the fastener 130 to secure the gate assembly's frame support 68 to the hinge's right member 36.

The left member 34 can have a support member 38 fixedly attached between it and a clamp 90. The support member 38 can have a length L6, where the length L6 is determined by the length of the support member 38 that is needed to position the left member 34 generally perpendicular to the surface 28 of the left portion 56 and adjacent the edge 76. The clamp 90 can be used to surround the post 20 and fixedly attach the left member 34 of the hinge 30 to the post 20. The post 20 can be a wooden or metal post, and can have different cross-sections than the circular cross-section shown in FIG. 3. For example, the post can be rectangular-shaped, such as 4×4, 4×6, 6×6, etc. treated lumber, somewhat oval-shaped with wooden or metal posts, etc.

The clamp 90 can at least partially surround the post 20 which can have a diameter 98. The arms of the clamp 90 that extend around opposite sides of the post 20 can be secured together by a fastener 94 and nut 96. By installing the nut 96 onto the fastener 94, the clamp arms are pulled together thereby squeezing the post between the arms and securing the left member 34 to the post 20. The fastener 94 can be any suitable fastener such as a bolt, a U-shaped bolt, a screw, etc.

The left and right members 34, 36 are pivotally attached at an axis 32, which allows the gate assembly 12 to pivot (as indicated by arrows 82) about the axis 32. The axis 32 can be a distance L7 in front of the surface 28 of the left portion 56, and the axis 32 can be a distance L8 in front of the surface 86 to accommodate various hinge 30 arrangements. It is preferred that the distances L7, L8 be a same value, but it is not required for these distances L7, L8 to be the same value. The distances L7, L8 can also be a value of "zero" if it is desired that the axis 32 aligns with the surfaces 28, 86.

The latch 40 can include the actuator 42 and the retainer 44. The actuator 42 can have a support member 48 fixedly attached between it and a clamp 50 (which can be similar to clamp 90). The support member 48 can have a length L9, where the length L9 is determined by the length of the support member 48 that is needed to position the actuator 42 generally perpendicular to the surface 28 of the right portion 58 and adjacent the edge 78. Please note that the support members 38, 48 can be made from a single piece of material with a constant cross-section. The support members 38, 48 can also be adjustable to accommodate adjustments in the field at time of installation. Adjustable can refer to slideable concentric sleeves to adjust length of the support members 38, 48, notching and/or scoring to assist length modification of the support members 38, 48, threaded inserts for length adjustments, etc. The clamp 50 can be used to at least partially surround the post 21 and fixedly attach the actuator 42 to the post 21. The post 21 can be a wooden or metal post (or any other suitable material), and can have different cross-sections than the circular cross-section shown in FIG. 3. For example, the post can be rectangular-shaped, such as with 4×4, 4×6, 6×6, etc. treated lumber, somewhat oval-shaped with wooden or metal posts, etc.

The clamp 50 can at least partially surround the post 21 which can have a diameter 98. The arms of clamp 50 can extend around opposite sides of the post 21 and can be secured together by a fastener 94 and nut 96. By installing the nut 96 onto the fastener 94, the clamp arms are pulled together thereby squeezing the post between the arms and securing the actuator 42 to the post 21.

The retainer 44 can be mounted to the surface 86 with a protrusion extending into engagement with the actuator 42 when the gate is latched in the closed position. The retainer 44 can be engaged and disengaged with the actuator 42 by pivoting (shown by arrows 82) about axis 32 and displacing (shown by arrows 84) the retainer 44 toward and away from the actuator 42. The actuator 42 may have a biasing device that holds the actuator 42 in a closed position. The actuator 42 may have a pivot 46 that allows opening and closing the actuator to retain or release the retainer 44.

Figure 4A:
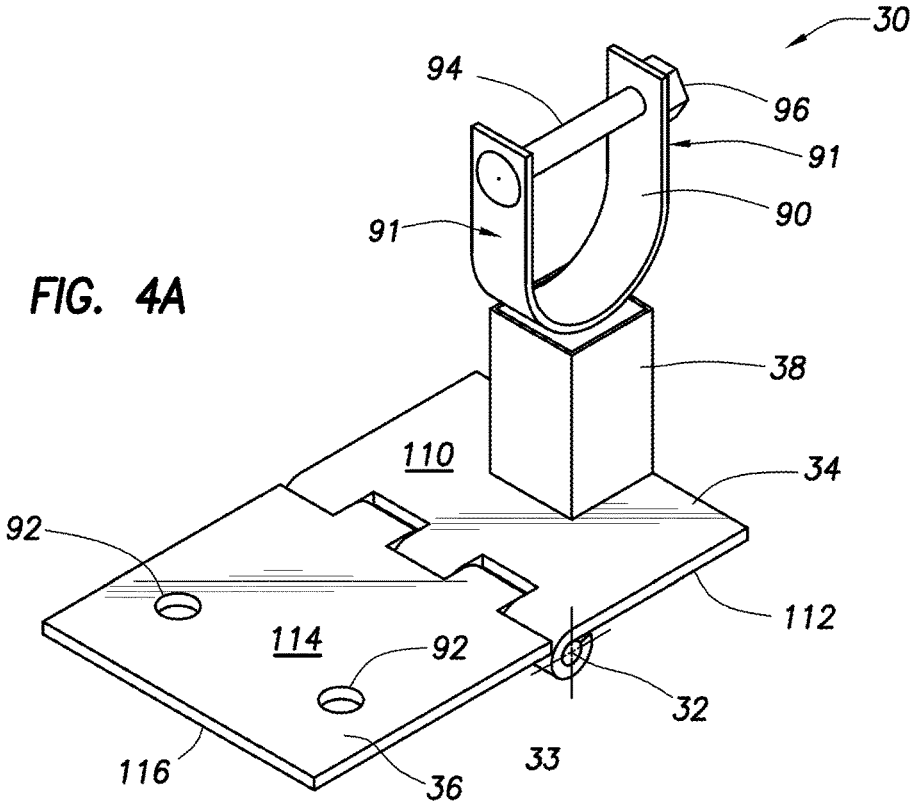
FIGS. 4A-4B are representative perspective views of two embodiments of a hinge which can embody principles of the present disclosure.
Figure 4B:
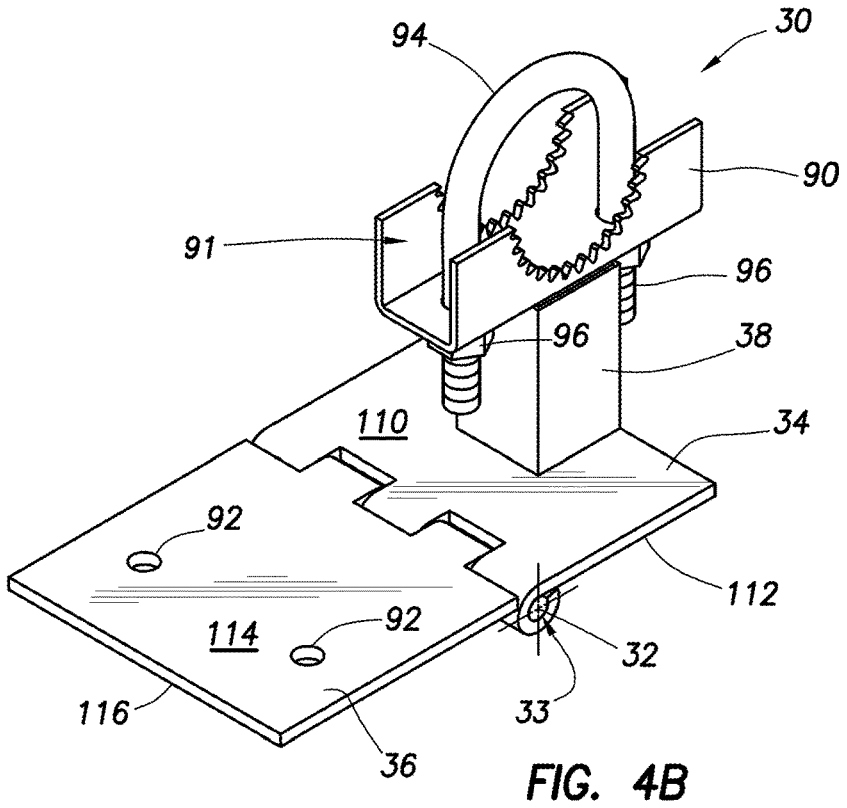

FIGS. 4A, 4B show perspective views of two embodiments of the hinge 30 which can embody principles of the current disclosure. FIG. 4A shows a hinge 30 with left and right members 34, 36, mounting holes 92, pivot 33 (such as a pin, etc.), axis 32, support member 38 and the clamp 90 with arms that are connected via the fastener 94 and nut 96. The right member 36 can have opposing surfaces 114, 116, with captive nuts 132 attached to the surface 116 at mounting holes 92. The left member 34 can have opposing surfaces 110, 112, with the support member 38 attached to the surface 110.

FIG. 4B shows a hinge 30 with left and right members 34, 36, mounting holes 92, pivot 33, axis 32, support member 38 and a clamp 90 made from a channel material with teeth formed in a semicircle arrangement that can mate up to a post 20 with a circular cross-section. The fastener 94 is shown as a U-bolt that can surround the post 20 and be secured to the clamp 90 via nuts 96, thereby securing the hinge 30 to the post 20. The right member 36 can have opposing surfaces 114, 116, with captive nuts 132 attached to the surface 116 at mounting holes 92. The left member 34 can have opposing surfaces 110, 112, with the support member 38 attached to the surface 110.

Figure 5A:
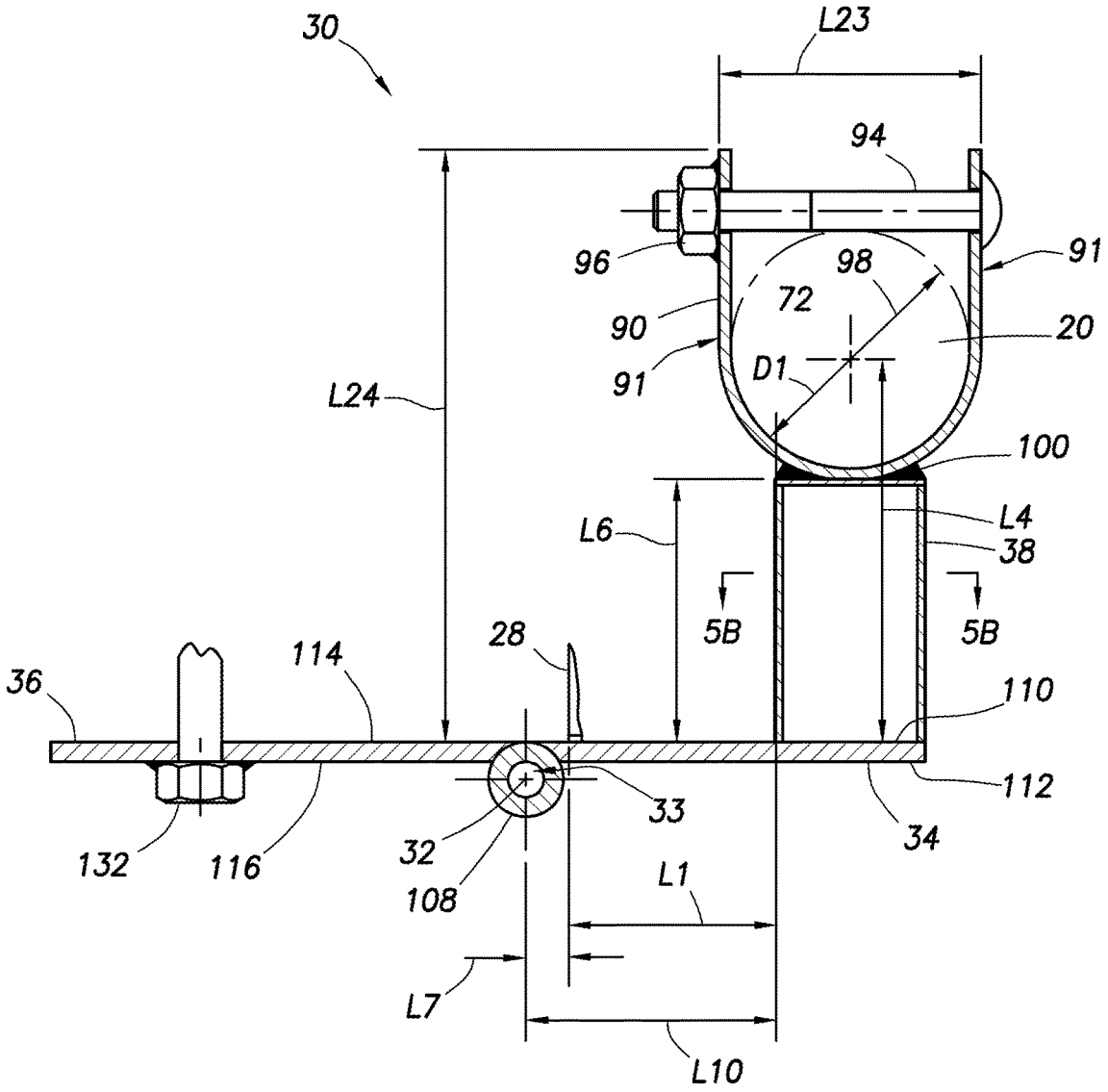
FIGS. 5A, 5B, 5C are a representative top view, a representative cross-sectional, and a representative rear view, respectively, of the hinge of FIG. 4A.
Figure 5B:
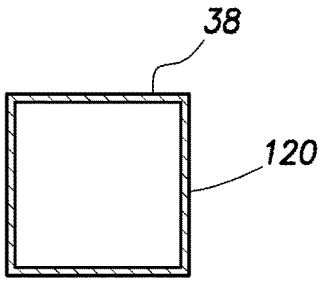
Figure 5C:
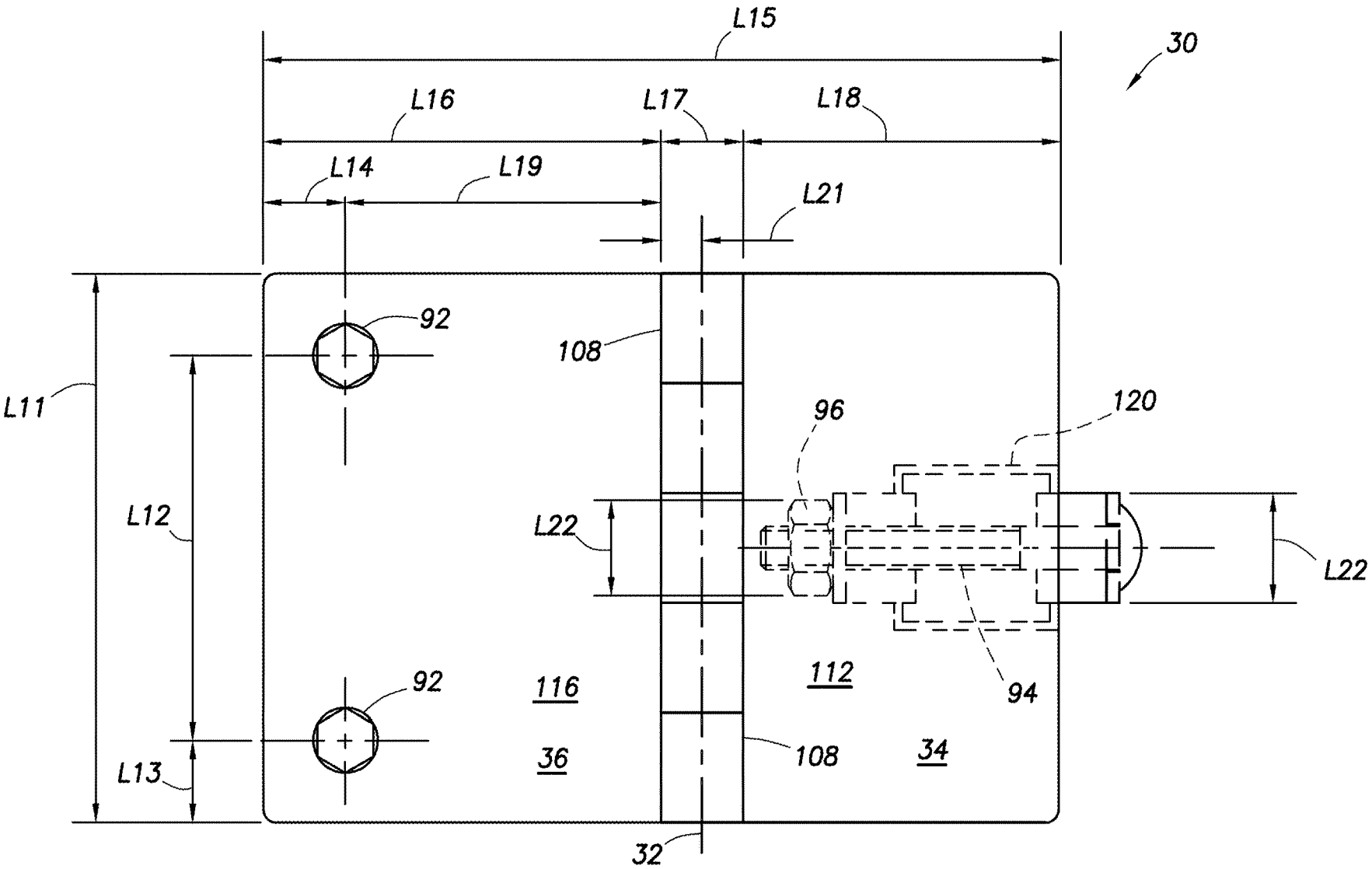

FIGS. 5A-5C are detailed views of the hinge 30 shown in FIG. 4A. FIG. 5A is a cross-sectional top view of the hinge 30 of FIG. 4A. The captive nuts 132 can be fixed to the surface 116 at the mounting hole 92. Length L24 is the length from the surface 110 to an extent of the clamp 90. Length L23 is a width of the clamp 90, where length L23 can determine the length needed for the arms to extend around the diameter 98 of the post 20. The length L6 is the length of the support 38 as measured from the surface 110 to an interface between the clamp 90 and the support member 38. Length L4 is the distance from the surface 110 to the center 72 of the post 20. Length L10 is the distance from the center 72 of the post 20 to the axis 32 of the hinge 30. This length L10 is also the combined lengths of length L1 and length L7, where length L1 is the distance from the axis 32 to the surface 28 of the left portion 56 of the fence system 10, and length L7 is the distance from the axis 32 to the surface 28.

FIG. 5B shows a representative cross-section of the support member 38 of the hinge 30. This view shows a substantially constant cross-section 120 of the support member 38. It is preferred that the cross-section of the support member 38 be substantially constant (or in other words substantially the same) for the length L6 of the support member 38. As used herein, "substantially constant cross-section" refers to a cross-section that is maintained along the specified length (e.g. L6) with about the same thickness of walls and about the same shape. There may be some anomalies in the cross-section along this length, but generally the cross-section is constant.

FIG. 5C details the relative lengths of the features and positions of features of the hinge 30 of FIG. 4A. L11 is the overall height of the hinge 30. L12 is the distance between centers of the mounting holes 92. L13 is the distance from the bottom of the hinge 30 to the center of the bottom one of the mounting holes 92. The hinge right member 36 has a surface 116 to which the nuts 132 can be attached. L14 is the distance from the edge of the right member 36 to the center of the mounting hole 92. It is preferred that the holes 92 are aligned with each other as shown in the figures, but this alignment is not required. L15 is the length of the overall width of the hinge 30 when it is in its fully open position. L16 is a width of the right member 36 excluding the hinge pivot surface 108. L18 is the width of the left member 34 excluding the hinge pivot surface 108. L17 is the width of a hinge pivot surface 108 of the hinge pivot. L19 is the distance from the center of the mounting hole 92 to the surface 108. L21 is the distance from the axis 32 to the hinge pivot surface 108. Cross-section 120 is shown as dashed lines for the support member 38. L22 is the width of the arms of the clamp 90.

Figure 6A:
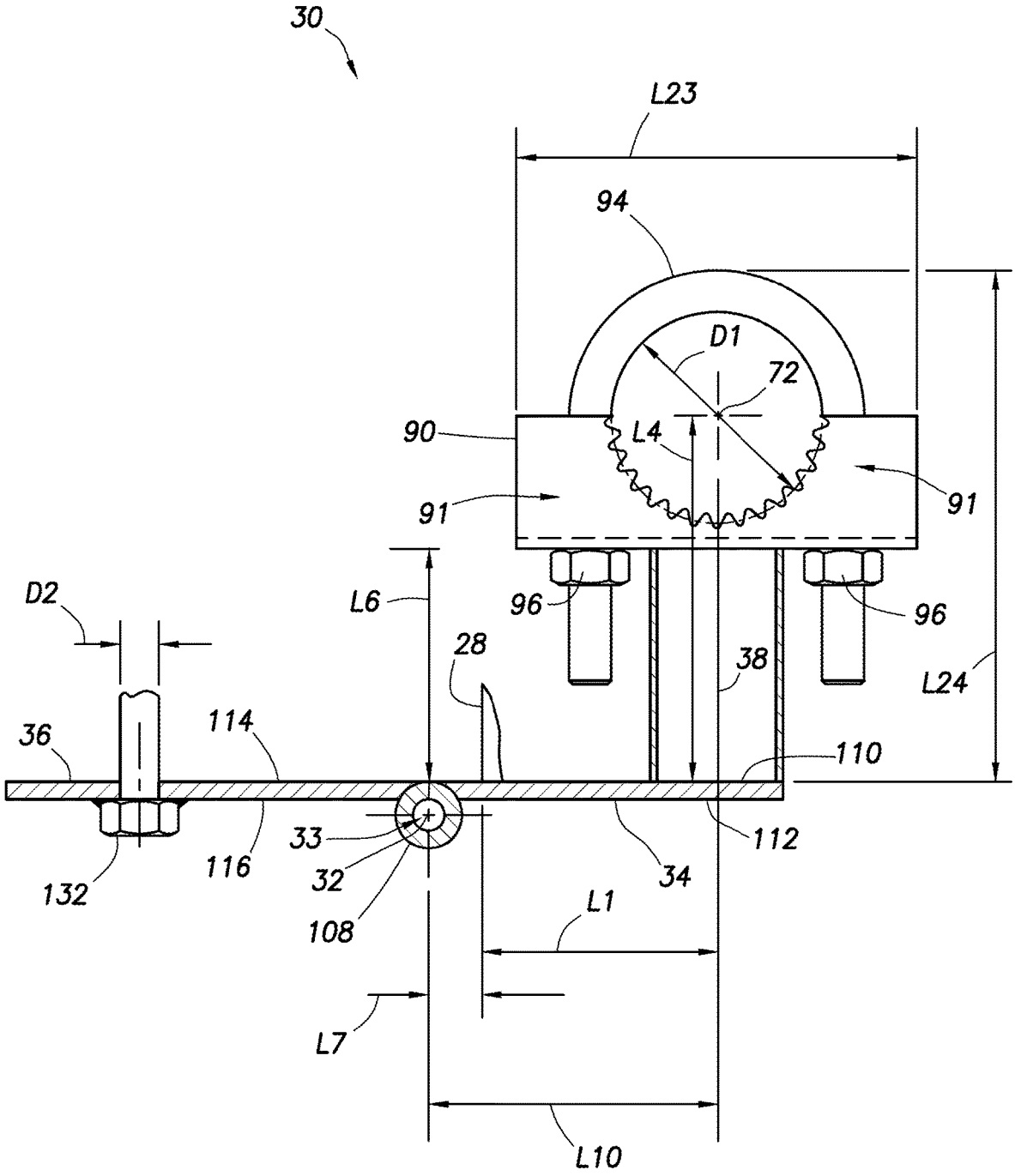
FIGS. 6A, 6B are a representative top view, and a representative rear view of the hinge of FIG. 4B.
Figure 6B:
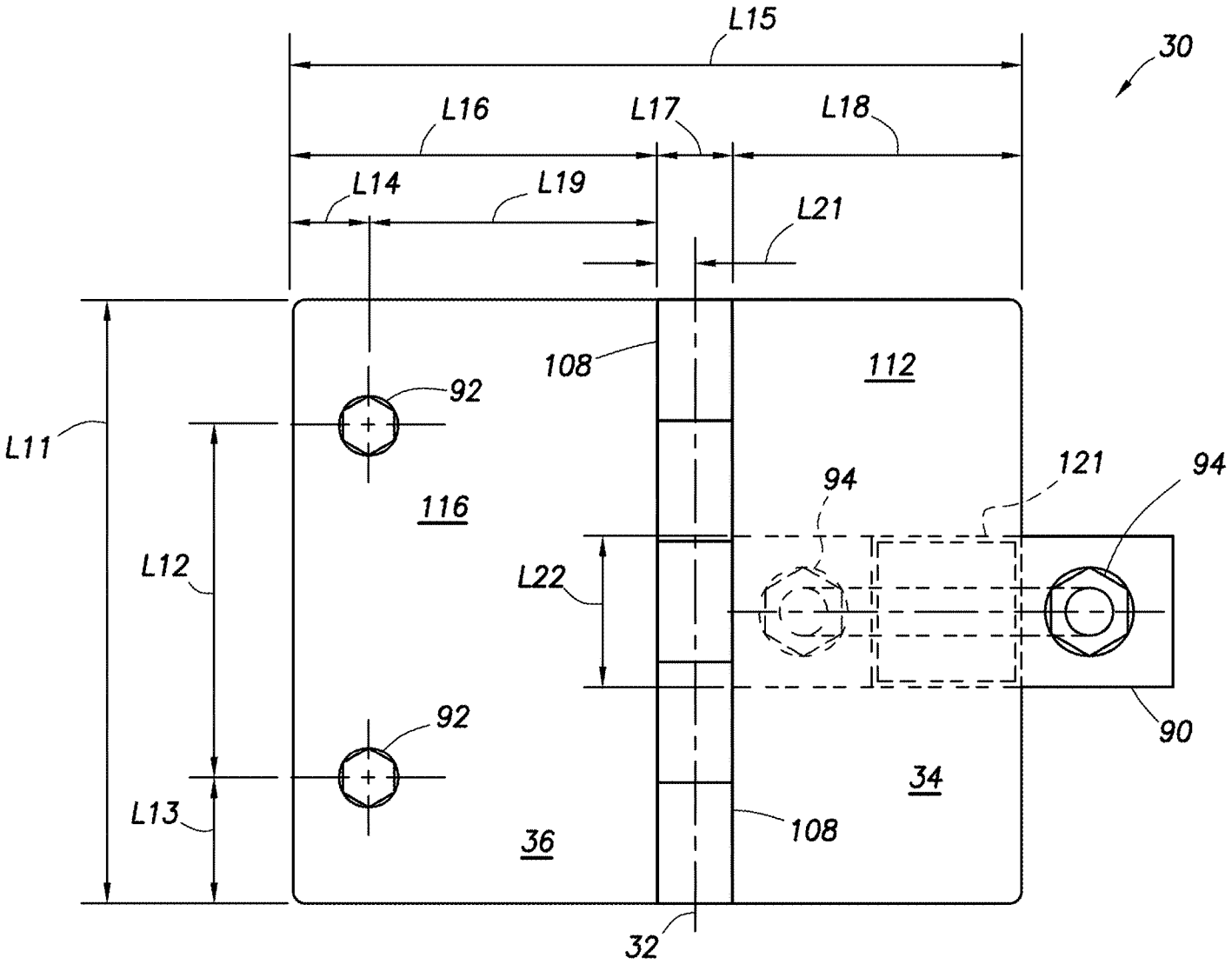

FIGS. 6A, 6B are detailed views of the hinge 30 shown in FIG. 4B. FIG. 6A is a cross-sectional top view of the hinge 30 of FIG. 4B. FIGS. 6A, 6B are very similar to FIGS. 5A and 5C, except that the clamp 90 is of a different configuration for mounting the hinge 30 to the post 20. The description above for FIGS. 5A, 5C is applicable to the lengths shown in FIGS. 6A, 6B with the same reference numerals.

Figure 7A:
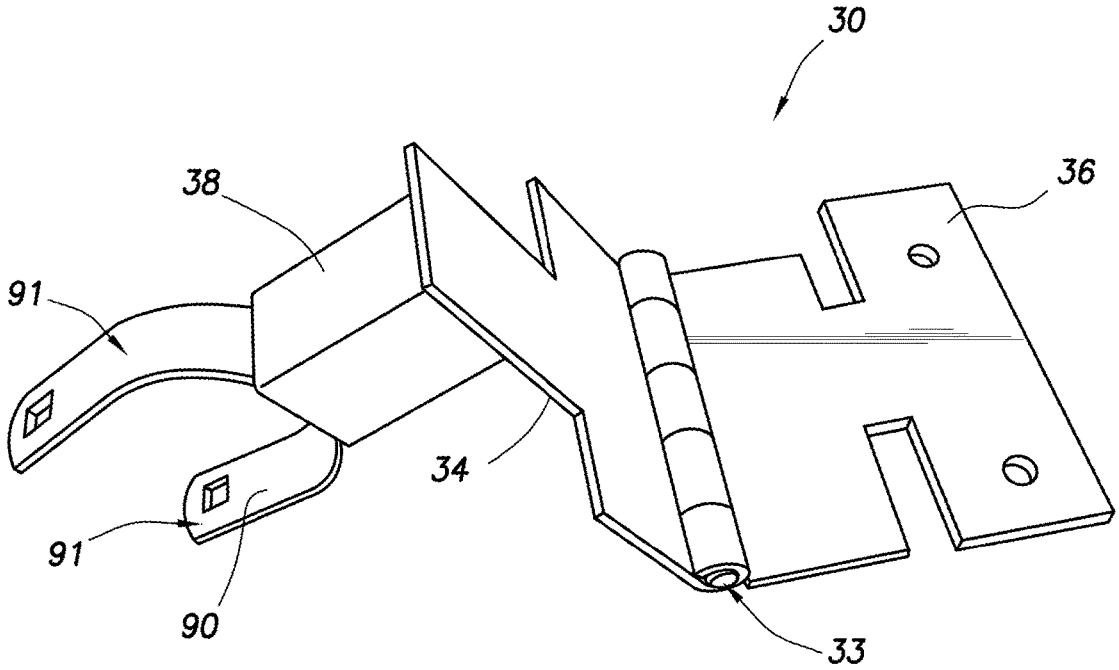
FIGS. 7A-7B are representative perspective views of the hinge of FIG. 4A which are partially pivoted about an axis.
Figure 7B:
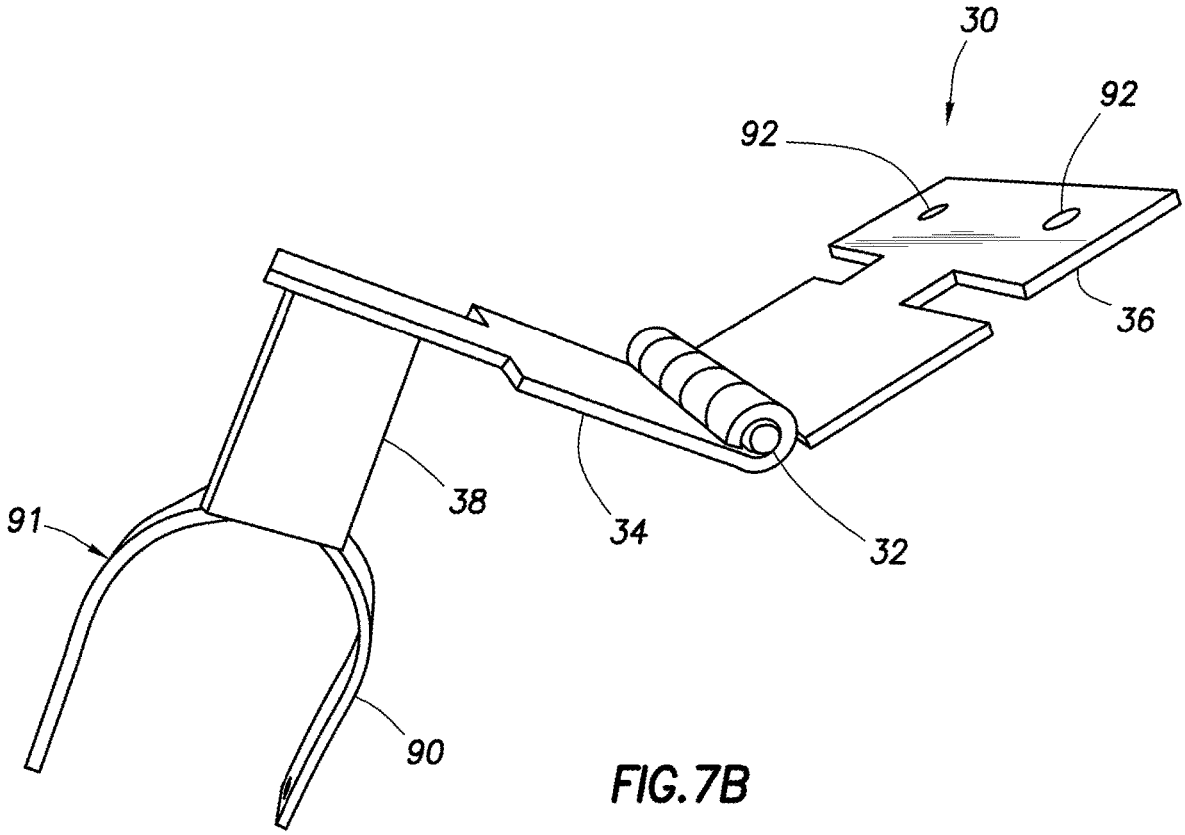

FIGS. 7A and 7B show perspective views of the hinge 30 with slightly different construction of the left and right members 34, 36, as compared to FIGS. 4A-6B.

Figure 8A:
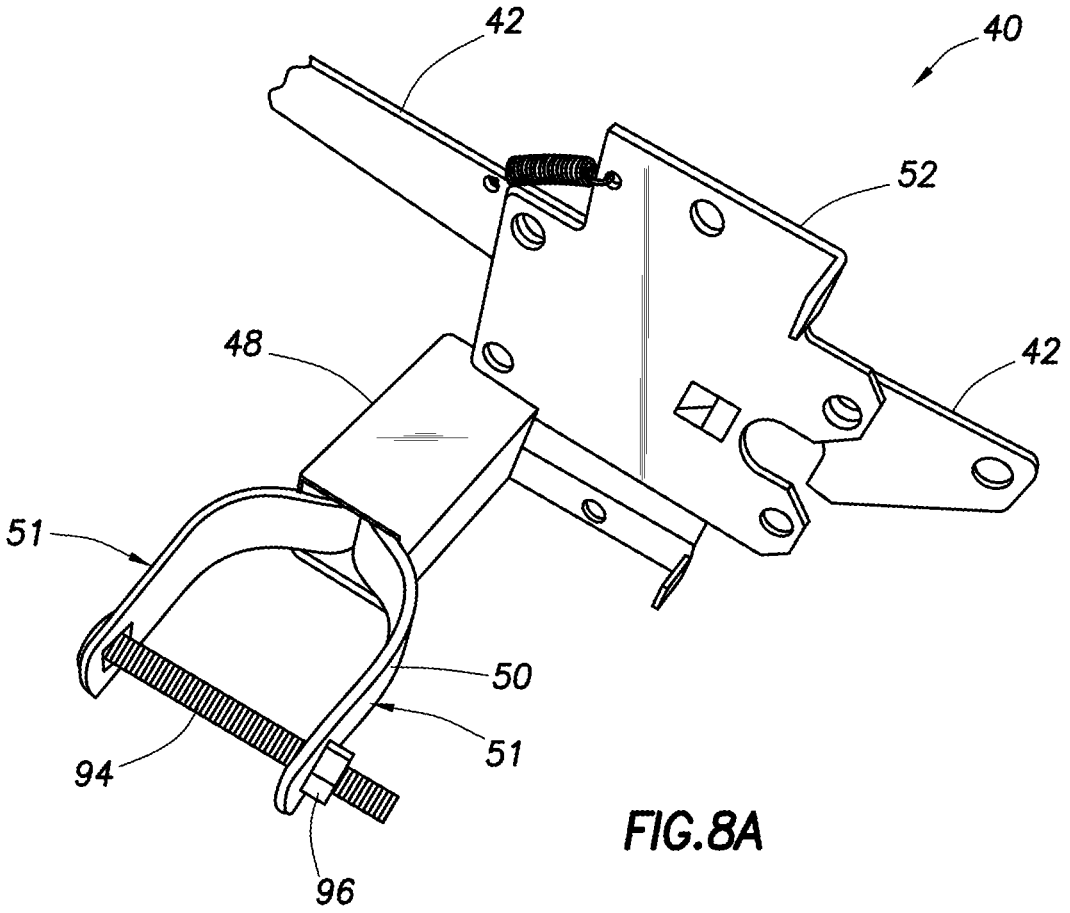
FIGS. 8A-8B are representative perspective views of a latch actuator for a latch that can embody principles of the present disclosure.
Figure 8B:
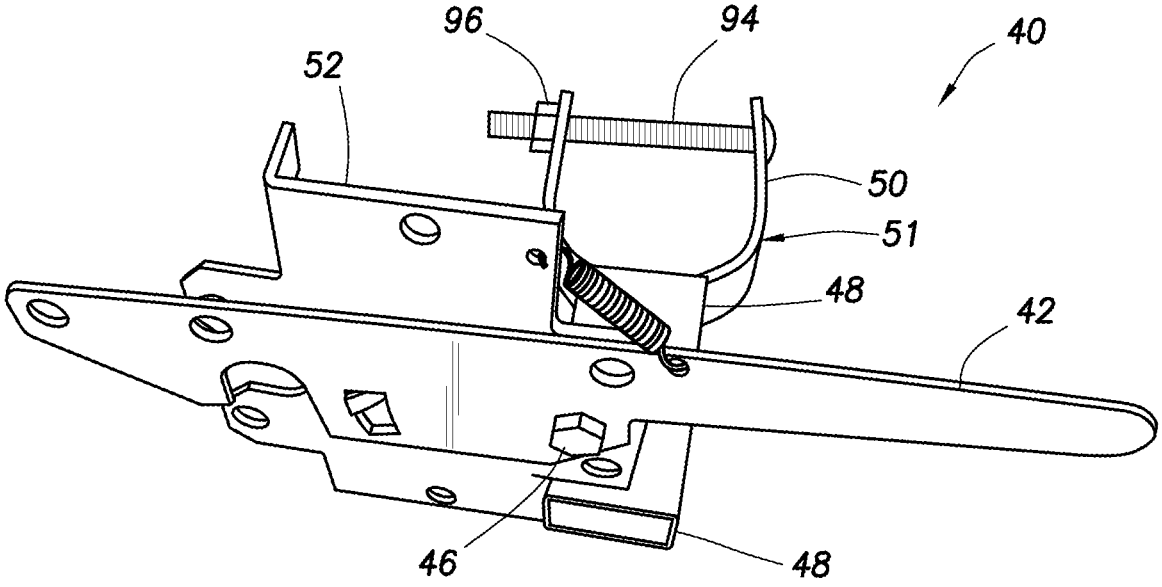

FIGS. 8A and 8B show perspective views of the latch 40, with actuator 42, and the retainer 44 not displayed. The actuator 42 can rotate about pivot 46 to retain and release the retainer 44. The clamp 50 is similar to the clamp 90 shown in FIG. 5A, but it is understood that the clamp 50 can also be similar to the different configurations shown for the clamp 90 in FIGS. 6A and 9A, as well as other configurations that have not been shown in the figures.

Figure 9A:
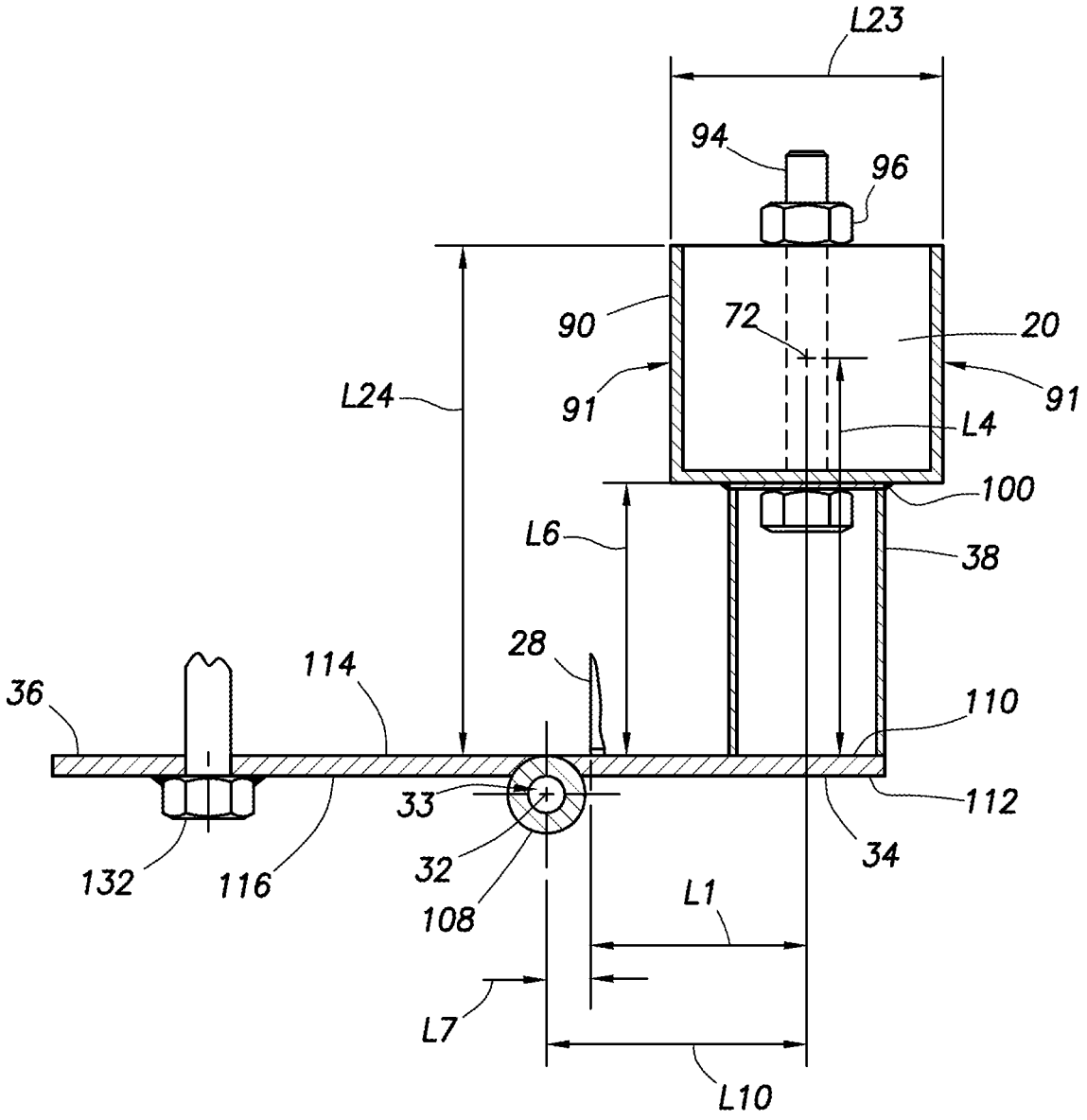
FIGS. 9A-9B are representative perspective views of another embodiment of a hinge which can embody principles of the present disclosure.
Figure 9B:
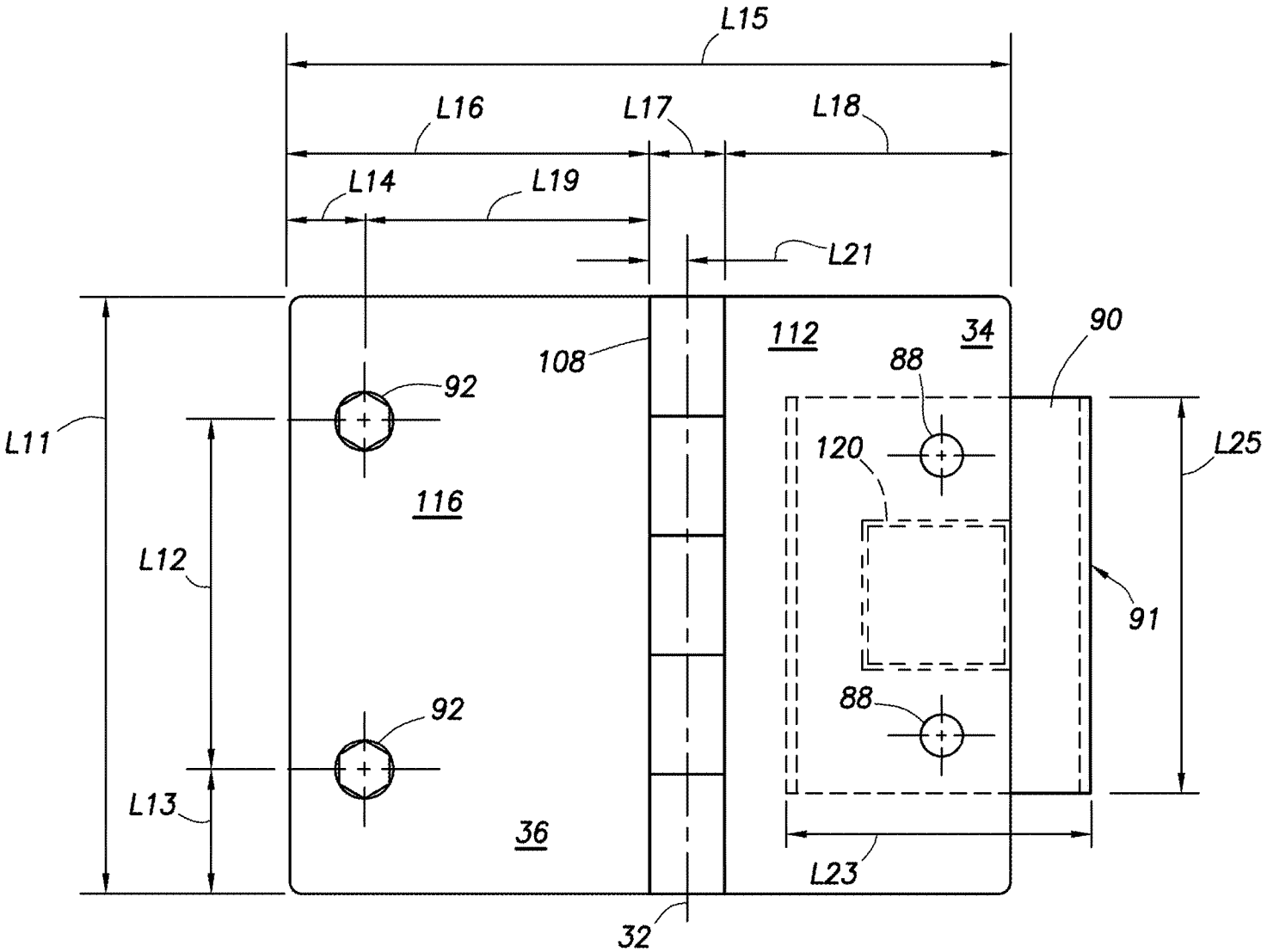

FIGS. 9A, 9B are very similar to FIGS. 5A and 5C, except that the clamp 90 is of a different configuration for mounting the hinge 30 to the post 20. The description above for FIGS. 5A, 5C is applicable to the lengths shown in FIGS. 9A, 9B with the same reference numerals, even though the lengths between these two versions can be different, the descriptions of the relative lengths are the same for the same reference numerals.

It will now be fully appreciated that the above disclosure provides several advancements to the art of fence systems.

Therefore, the present system is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention.

As used herein, the words "comprise," "have," "include," and all grammatical variations thereof are each intended to have an open, non-limiting meaning that does not exclude additional elements or steps. While compositions and methods are described in terms of "comprising," "containing," or "including" various components or steps, the compositions and methods also can "consist essentially of" or "consist of" the various components and steps. It should also be understood that, as used herein, "first," "second," and "third," are assigned arbitrarily and are merely intended to differentiate between two or more objects, etc., as the case may be, and does not indicate any sequence. Furthermore, it is to be understood that the mere use of the word "first" does not require that there be any "second," and the mere use of the word "second" does not require that there be any "first" or "third," etc.

The terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

In the above description of the representative examples of the disclosure, directional terms, such as "left", "right", "above," "below," "upper," "lower," etc., are used for convenience in referring to the accompanying drawings. In general, "left" and "right" and similar terms refer to horizontal directions relative to the earth's surface and relative to the view of the drawing figure. In general, "above," "upper," "upward" and similar terms refer to a direction above the earth's surface, and "below," "lower," "downward" and similar terms refer to a direction closer to the earth's surface than the "above," "upper," and "upward" terms.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A fence system, where the system comprises:

a first fence portion;

a gate assembly; and at least one hinge, wherein the first fence portion comprises a first post, a backer rail, and a plurality of fence pickets, wherein the first post is mounted on a first side of the backer rail and the plurality of fence pickets is mounted on a second side of the backer rail that is opposite the first side of the backer rail, wherein the at least one hinge rotatably mounts the gate assembly to the first post, wherein the hinge comprises a clamp that straddles the first post and secures the hinge to the first post, wherein the at least one hinge defines an axis about which the gate assembly rotates between an open position and a closed position, wherein the axis is spaced away from the first side of the backer rail, and wherein an entirety of the axis is positioned on the second side of the backer rail and an entirety of the first post is positioned on the first side of the backer rail at least when the gate is in the closed position.

2. The fence system of claim 1, wherein the hinge further comprises:

first and second members; and a support member is attached between the first member and the clamp, wherein the support member positions the clamp at a location that is spaced apart from the first member, and wherein the support member has a substantially constant cross-section.

3. The fence system of claim 2, wherein the support member is perpendicular to the first member.

4. The fence system of claim 2, wherein the clamp is secured to the first post by at least one fastener, and wherein the second member is attached to the gate assembly, thereby rotatably mounting the gate assembly to the first post.

5. The fence system of claim 4, wherein the fastener connects opposite arms of the clamp to secure the clamp to the first post.

6. The fence system of claim 4, wherein the fastener comprises one of a bolt, a U-shaped bolt, and a screw.

7. The fence system of claim 1, further comprising a second fence portion, wherein the gate assembly is positioned between the first fence portion and the second fence portion, wherein a latch retainer is attached to the gate assembly, and a latch actuator is attached to the second fence portion, and wherein engagement of the latch retainer with the latch actuator latches the gate assembly in the closed position.

8. The fence system of claim 7, wherein rotation of the latch actuator selectively releases the latch retainer, thereby permitting rotation of the gate assembly from the closed position, and wherein the latch retainer is attached to a metal support of the gate assembly.

9. The fence system of claim 7, wherein the second fence portion includes a second post, and wherein the latch actuator is attached to the second post by a second clamp that straddles the second post and secures the second post to the latch actuator.

10. The fence system of claim 9, wherein the second clamp is secured to the second post by at least one fastener, and wherein the fastener comprises one of a bolt, a U-shaped bolt, and a screw.

11. A fence system, where the system comprises:

a fence portion including a plurality of fence pickets mounted on a first side of a backer rail, and a second opposite side of the backer rail is mounted on a post; and a gate assembly rotatably mounted to the post by at least one hinge, wherein the hinge comprises a first clamp that straddles the post and secures the hinge to the post, wherein the at least one hinge defines an axis about which the gate assembly rotates between an open position and a closed position, and wherein an entirety of the axis is positioned on the first side of the backer rail and an entirety of the post is positioned on the second side of the backer rail at least when the gate assembly is in the closed position.

12. The fence system of claim 11, further comprising a second hinge, wherein the second hinge comprises a second clamp that straddles the post and secures the second hinge to the post, wherein the second hinge rotates about the axis side of the first.

13. The fence system of claim 12, wherein the hinges rotatably attach the gate assembly to the post without direct attachment of the hinges to the plurality of fence pickets or to the backer rail.

14. A method of installing a fence system, the method comprising:

mounting a first side of a backer rail to a first post;

mounting a plurality of fence pickets to a second side of the backer rail that is opposite the first side;

mounting a first member of a hinge to the first post, wherein the mounting includes clamping a clamp of the hinge around the first post; and mounting a second member of the hinge to a gate assembly, thereby rotatably attaching the gate assembly to the first post, wherein an entirety of the first post is positioned on the first side of the backer rail, and wherein an entirety of an axis defined by the hinge and about which the gate assembly rotates between a closed position and an open position is positioned on the second side of the backer rail, at least when the gate assembly is in the closed position.

15. The method of claim 14, further comprising:

mounting a latch retainer to an end of the gate assembly located opposite from the hinge; and mounting a latch actuator to a second post, wherein the latch retainer and the latch actuator are releasably engageable.

16. The method of claim 15, further comprising:

rotating the gate assembly to engage the latch actuator with the latch retainer, thereby holding the gate assembly in the closed position.

17. The method of claim 14, wherein the mounting of the first member includes mounting the first member to the first post without directly mounting the first member to the plurality of fence pickets or to the backer rail.

* * * * *